US006097003A

United States Patent [19]

Markum et al.

[11] Patent Number: 6,097,003

[45] Date of Patent: Aug. 1, 2000

[54] SUPPORT BAR ATTACHMENT FOR AN ELECTRIC HEATER ELEMENT

[75] Inventors: Randall Markum; Stacy V. Springer, both of County of Lamar, Ala.; John H. Warner, County of Lowndes, Miss.

[73] Assignee: Emerson Electric Company, St. Louis, Mo.

[21] Appl. No.: 09/005,088

[22] Filed: Jan. 9, 1998

[51] Int. Cl.[7] ..... H05B 3/06

[52] U.S. Cl. ..... 219/402; 219/536; 219/537; 338/316; 338/317; 338/320

[58] Field of Search ..... 219/402, 408, 219/520, 532, 536, 537, 400, 403; 373/114, 119, 1, 128, 129, 130–131; 432/209; 338/316, 317, 318–320

[56] References Cited

U.S. PATENT DOCUMENTS

| | | | |
|---|---|---|---|
| 2,799,766 | 7/1957 | Tuttle | 219/37 |
| 3,005,082 | 10/1961 | Ammerman | 219/35 |
| 3,154,669 | 10/1964 | Binder | 219/404 |
| 3,770,939 | 11/1973 | Kokjohn | 219/363 |
| 4,272,638 | 6/1981 | Cimochowski | 13/25 |
| 4,392,052 | 7/1983 | Magnusson et al. | 219/536 |

FOREIGN PATENT DOCUMENTS

| | | | |
|---|---|---|---|
| 626997 | 9/1961 | Canada | 219/403 |
| 1565683 | 3/1970 | Germany | 219/537 |

*Primary Examiner*—John A. Jeffery
*Attorney, Agent, or Firm*—Polster, Lieder, Woodruff & Lucchesi, L.C.

[57] ABSTRACT

An apparatus (10) supports an electrical heating element (H) which is mounted in an oven (O). When supplied with electricity, the element heats the oven to cook food. During an operating cycle, the heating element expands and contracts along its length. The apparatus comprises a support bar (12) including an elongate plate (16) and bracketry (14) for mounting the plate to an inner wall (T) of the oven. The support bar extends orthogonally of a longitudinal axis of the heating element when the heating element is installed. The plate has spaced openings (18), each of which is sized for a length of the heating element to be fitted in an opening. Each opening comprises a slot one end of which extends into the body of the plate for a portion of the plate to cover the slot. The other end of the slot is open to receive the heating element, the portion of the heating element received in each slot being fitted into the covered end of the slot. The segments of the heating element are constrained in the slots when the heating element heats up due to flow of electricity through the element so the segments expand only along a desired axis of the heating element.

19 Claims, 4 Drawing Sheets

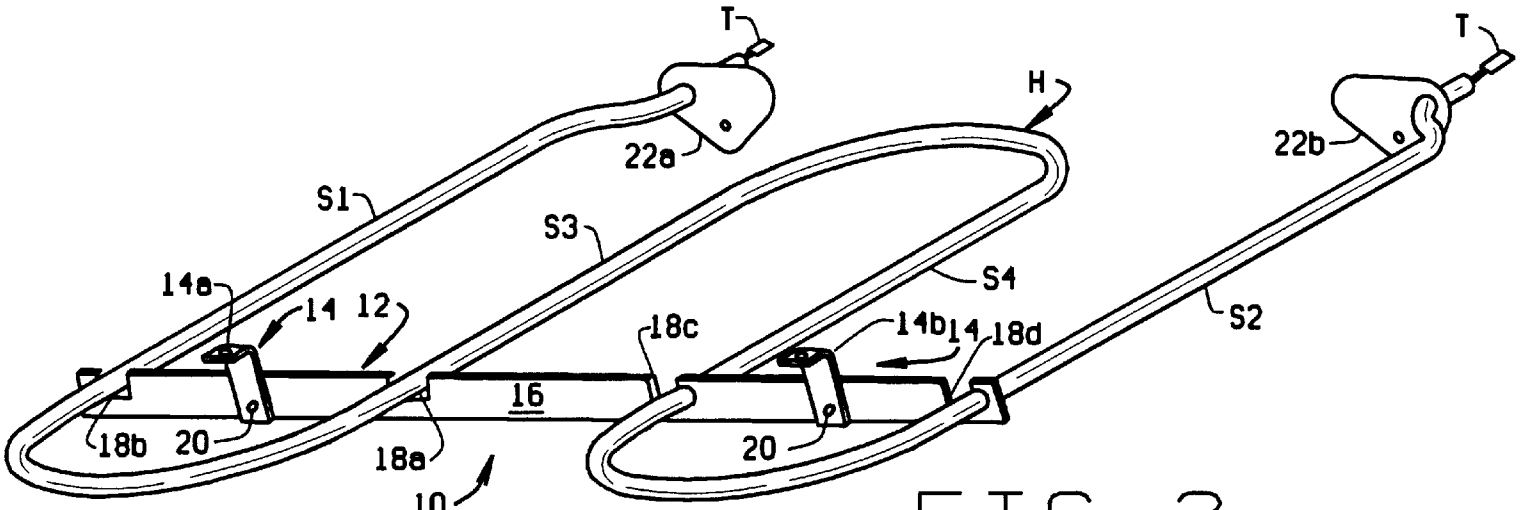
FIG. 3
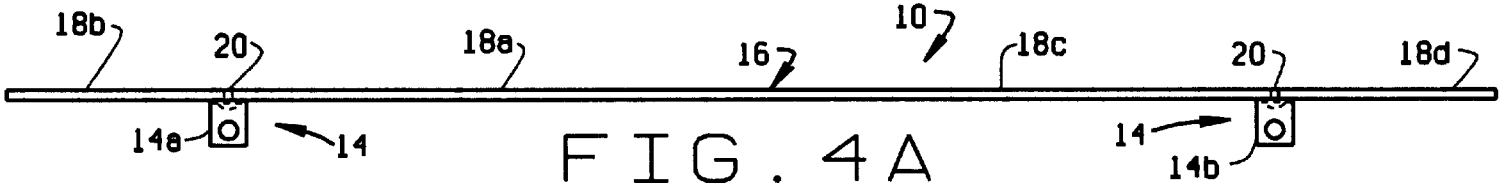
FIG. 4A
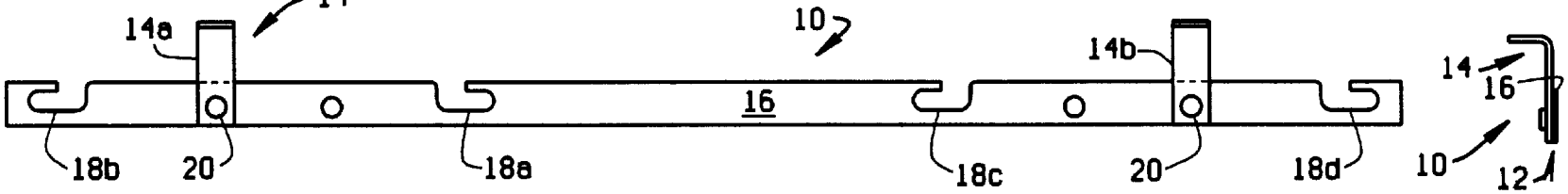
FIG. 4B
FIG. 4C

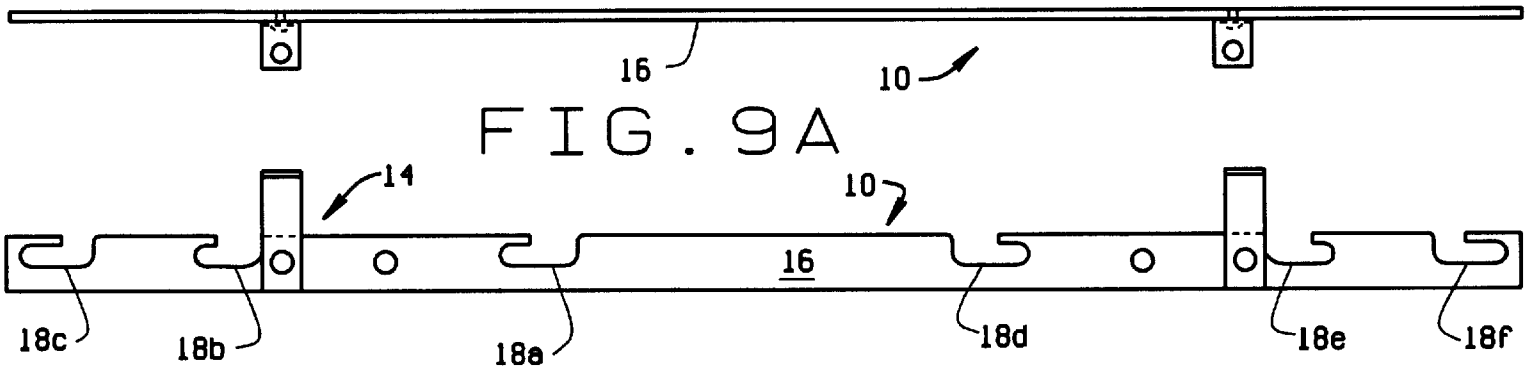
FIG. 9A
FIG. 9B
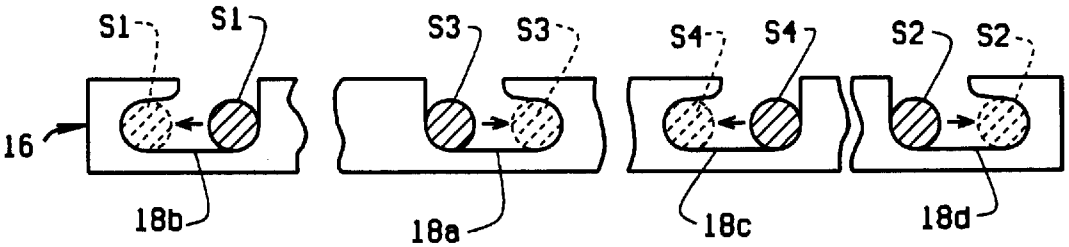
FIG. 10
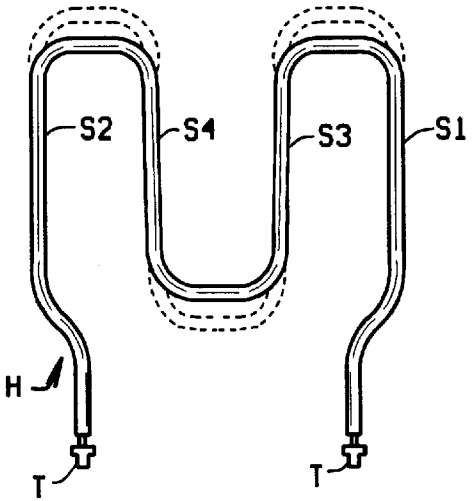
FIG. 8

SUPPORT BAR ATTACHMENT FOR AN ELECTRIC HEATER ELEMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to electrical ovens in which food is cooked, and more particularly, to a support bar for use with one or more electrical heating elements mounted in the oven and providing the heat used for cooking the food.

As is well-known, electric stoves have an oven in which an electric heating element (or elements) is mounted. The heating element, when energized, produces the heat used to bake or broil food set in the oven. It is typical to install the heating element in the oven so it is suspended immediately below the top surface of the oven. A heating element, when electricity is supplied to it, expands along its length as it heats up. When electricity is removed, the heating element contracts as it cools. Installation of the heating element must therefore be in such a way as to take into account these dimensional changes. Failure to do so will result in failure of the heating element and loss of use of the oven until the element is replaced.

A heating element of the type used in ovens has an electrical terminal in each end. These ends attach to electrical receptacles located at the backwall of the oven. Or, the oven has spaced openings through which the terminals are inserted for mating connection with electrical terminals located behind the oven. One way of installing the heater is to rigidly attach the terminal ends of the heating element to an electrical connector located at the backwall of the oven. A flexible hangar is then suspended from the top wall of the oven and the heating element is attached to the hangar. As the heating element expands and contracts, the flexibility of the hangar accommodates the expansion and contraction of the element. A J-hook is an example of a hangar which allows such movement. Another type of installation in which the terminals rigidly mount to a connector at the rear of the oven includes rails extending along the sidewalls of the oven. A portion of longitudinal sections of the heating element is supported by the rails which, again, allows the heating element to expand and contract along its length while being supported. In some instances, the heating element is rigidly mounted in place, but the receptacles to which the terminal ends of the element attach are not rigid but flex. This again permits the heating element to expand and contract due to the flexibility in the electrical connection.

While each of these methods of installation accommodate the relative movement of a heating element, each has drawbacks with respect to longevity of use, prevention of dislodgment or breakage of the heating element, cost, and ease of installation and replacement (both of the installation means and the heating element). It would therefore be helpful to have a simple, readily installed support means which reliably supports the heating element.

BRIEF SUMMARY OF THE INVENTION

Among the several objects of the present invention may be noted the provision of a support bar for use in an electric oven for supporting an electric heating element used to cook food set into the oven;

the provision of such a support bar to rigidly mount to an inside wall of the oven but to support the heating element so as to allow full expansion and contraction of the heating element;

the provision of such a support bar which is readily installed in the oven;

the provision of such a support bar having a plurality of spaced slots in which a portion of respective longitudinal segments of the heating element are supported;

the provision of such a support bar in which the slots are open at one end to facilitate insertion of the heating element, and closed at the other end, the heating element engaging enclosed ends of the slots to restrain movement of the heating element except along its longitudinal axis as the heating element heats up and cools down;

the provision of such a support bar in which the heating element can be readily removed without damaging it, and in which a replacement element can be readily installed;

the provision of the invention to provide a support bar for supporting two, separate heating elements and to support both heating elements during their expansions and contractions;

the provision of such a support bar to be available is different sizes for use with different size heating elements; and, the provision of such a heating element to provide a low cost yet dependable way of installing electrical heating elements in ovens.

In accordance with the invention, generally stated, apparatus is provided for supporting an electrical heating element which is mounted in an oven. When supplied with electricity, the element heats the oven to cook food placed in the oven. During an operating cycle, the heating element expands and contracts along its length. The apparatus comprises a support bar including an elongate plate and bracketry for mounting the plate to an inner wall of the oven. The support bar extends orthogonally of a longitudinal axis of the heating element when the heating element is installed. The plate has spaced openings formed in it, each opening being sized for a length of the heating element to be fitted in an opening. Thus, various portions of the heating element are supported by the support bar. Each opening comprises a slot one end of which extends into the body of the plate for a portion of the plate to cover the slot. The other end of the slot is open to receive the heating element, the portion of the heating element received in each slot being fitted into the covered end of the slot. The heating element is thereby constrained in the slots when the heating element heats up due to flow of electricity through the heating element. Other objects and features will be in part apparent and in part pointed out hereinafter.

BRIEF DESCRIPTION OF THE SEVERAL VIEWS OF THE DRAWINGS

In the drawings.

FIG. 3 is a perspective view of the heating element and support bar assembly;

FIG. 4A is a top plan view of the support bar, FIG. 4B is a front elevational view, and FIG. 4C is a side elevational view of the support bar;

FIG. 8 is a representation of the expansion of a heating element when an oven is in use;

FIG. 9A and 9B are respective top plan and elevational views of a support bar for use with two heating elements; and, FIG. 10 is a broken elevational view of the support bar illustrating installation and support of a heating element by the support bar.

Corresponding reference characters indicate corresponding parts throughout the drawings.

DETAILED DESCRIPTION OF THE INVENTION

Figure 1:
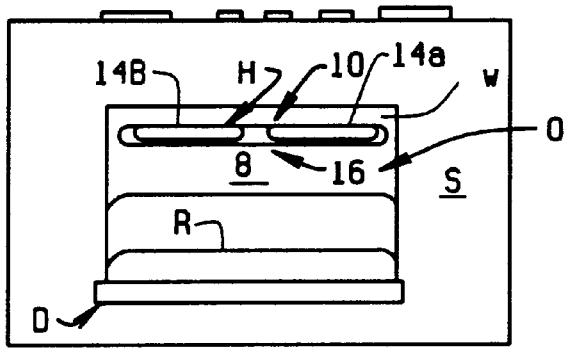
FIG. 1 is a front view of a stove with its oven door open and illustrating installation of a heating element in the oven.
Figure 2:
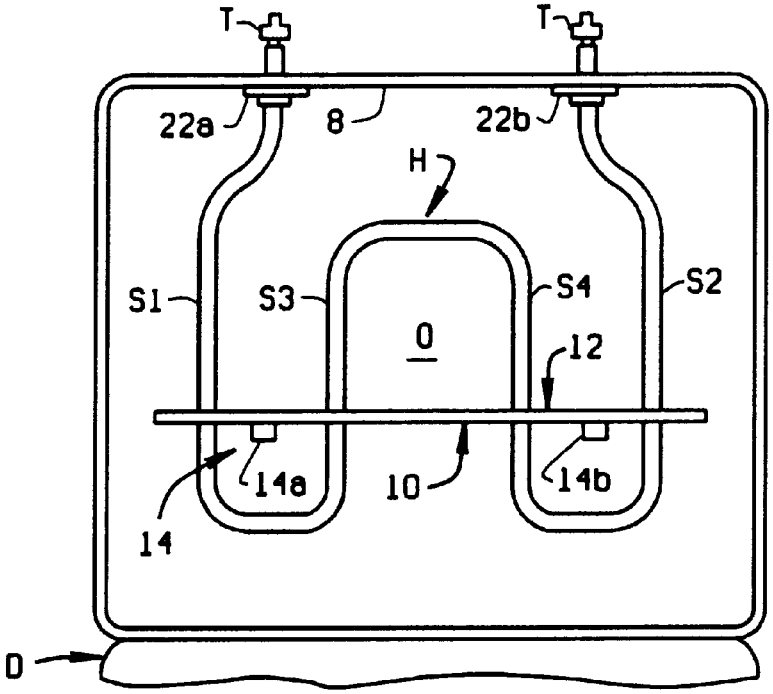
FIG. 2 is a top plan view of the oven illustrating the heating element and a support bar of the present invention for mounting the heating element in the oven.
Figure 5:
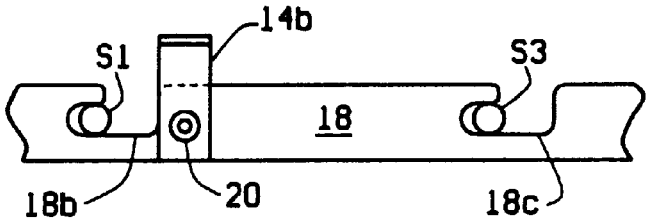
FIG. 5 is a partial elevational view of the support bar illustrating installation of the heating element thereon.

Referring to the drawings, an electric stove S is shown in FIG. 1 to include and oven O. The oven has a door D to close it, and one or more racks R on which food to be cooked is placed inside the oven. As shown in FIGS. 2 and 8, the heating element comprises a single piece heating rod which is formed so to have a sinuous shape or contour. The heating element has electrical terminals T installed at each end of the rod. The terminals fit into electrical connectors (not shown) which are adjacent a backwall B of the oven. The heating element is contoured to have two outer longitudinal segments or reaches S1 and S2 and two inner longitudinal segments or reaches S3 and S4. When installed in the oven, as shown in FIG. 2, the length of the heating element is such that it extends substantially the length of the oven from the backwall to the open, front portion of the oven closed by door D. With respect to FIG. 8, there it is shown that when a current flows through the heating element, causing the element to heat up, the segments S1–S4 of the heating element expand along their length. This expansion is represented by the dashed lines in the drawing. It will be understood that the expansion coefficient for the materials commonly used in a heat exchanger is known. Also, for a heating element contoured as shown in the drawings, the expansion and subsequent contraction of the rod is along the longitudinally extending segments of the element and the apparatus of the present invention is designed to so constrain such movements.

Referring again to FIG. 1, heating element H is installed in the oven near the top of the oven. As so installed, the heating element is normally maintained in place using an apparatus 10 of the present invention. Apparatus 10 is designed to support the heating element so that the element can freely expand and contract along its longitudinal axis and do so repeatedly without damaging either the heating element the electrical connection between the heating element and a control circuit by which current is supplied to the element, and a support for the heating element. Apparatus 10 includes a support bar 12 and bracket means 14 for mounting the support bar in the oven. The bracket means allows the support bar to be suspended from a top wall W of the oven as shown in FIG. 1. The support bar includes an elongate plate 16 which is generally rectangular when viewed in elevation, as shown in FIG. 4B. The plate includes series of slots 18*a*–18*d* spaced along the length of the plate, again as viewed in FIG. 4B. The slots open into the body of plate 16 from the top of the plate. The support bar also is available in different lengths to fit in different size ovens and for use with different size heating elements.

The length of plate 16 is such that it extends substantially across the width of the oven. The length of the plate is greater than the width of the heating element as measured between the outer longitudinal segments S1, S2 of the element. The support bar is installed so the center of the plate corresponds to the longitudinal axis or centerline of the heating element. Slots 18*a*, 18*b* are formed in the plate to one side of the centerline, and slots 18*c*, 18*d* are formed in the plate to the other side of the centerline. Slots 18*a* and 18*c* are equidistantly spaced with respect to the centerline, as are slots 18*b*, 18*d*. Each of the slots is formed such that one end of the slot is open, while the other end of the slot is covered by a portion of the plate. That is, the slots are formed in an elongated J shape. The height of each slot (including the covered portion of the slot) at least corresponds to the diameter of the respective segment S1–S4 of the heating element to be fitted in the slot. Also, the width of each slot is at least twice the diameter of the segments with the width of the covered portion of each slot being at least equal to the diameter of a segment. As shown in FIGS. 4B and 10, for slots 18*a* and 18*c*, the portion of the slots covered by the plate are the inward ends of the slot. Slots 18*b* and 18*d* have their outward ends covered by a portion of the plate material. Referring to FIG. 10, when a heating element H is installed in the oven, each of the longitudinal segments S1–S4 of the element are slightly compressed and as so compressed placed in the uncovered portion of the respective slot in which they are received. When released, each segment moves as shown by the arrows in FIG. 10 from their solid line position to their dashed line position. In their dashed line positions, each segment now resides in the covered portion of their respective slot. During cooking, when current is supplied to the heating element causing expansion of the element as shown in FIG. 8, each segment S1–S4 of the heating element is constrained to move only parallel to the longitudinal axis of the heating element. As a result, there is no warpage (twisting) in the heating element. This, in turn, produces a more uniform distribution of heat throughout the oven than if the heating element were not so constrained.

Bracket means 14 comprises a pair of inverted L-shaped brackets 14*a*, 14*b* the stem of which is secured to plate 16 in any suitable manner; for example, by a rivet 20. The brackets are secured to the top wall of the oven using a rivet or screw (not shown) or other suitable means of attachment. The terminal ends of the heating element are fit through respective mounting brackets 22*a*, 22*b* which comprise plates having openings therein sized for the rod portion of the heating element to fit. These brackets are secured to the back wall B of the oven; again, in any suitable manner.

Figure 6:
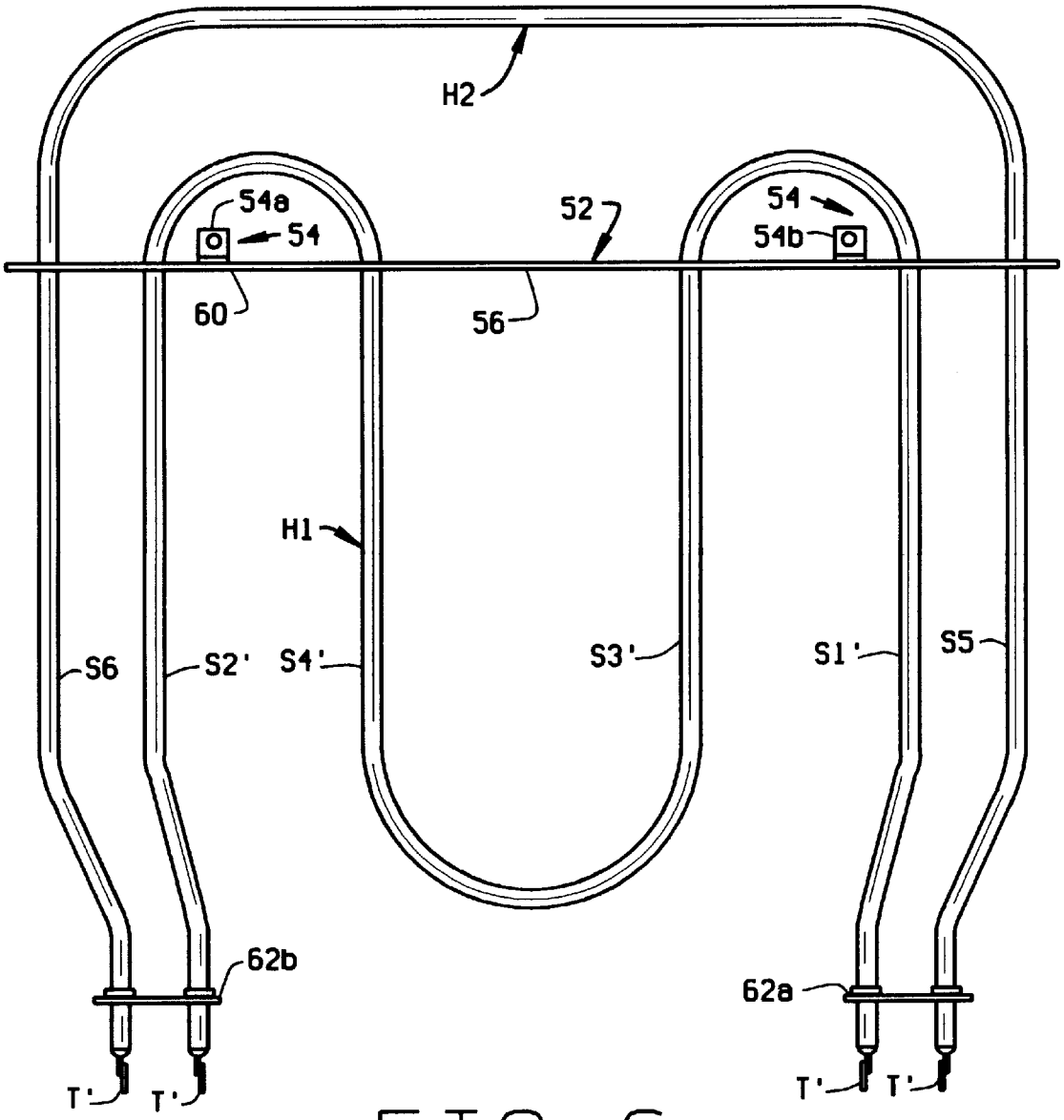
FIG. 6 illustrates an alternate heating element installation in an oven in which two heating elements are used.
Figure 7:
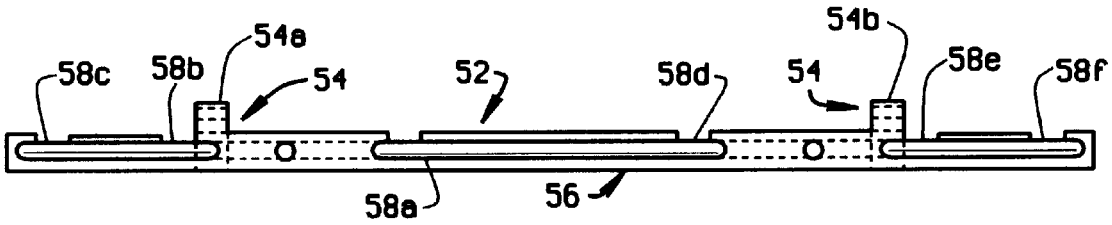
FIG. 7 is an elevational view of an alternate embodiment of the support bar used with the two heating elements.

Referring to FIGS. 6, 7, 9A and 9B, a second embodiment of the invention is for use with an oven in which a pair of heating elements H1, H2 are installed. As shown in FIG. 6, heating element H1 generally corresponds to the heating element H previously described and includes longitudinal segments S1'–S4'. Heating element H2, which is installed in the oven so to be coplanar with heating element H1, is a generally U-shaped heating element having longitudinal segments S5 and S6. Both heating elements have electrical terminations T' at their respective ends. Heating element H2 is wider than element H1 so, when installed, element H2 encompasses or surrounds element H1 as shown in FIG. 6. However, the longitudinal axis of heating element H1 coincides with that of heating element H2. It will be understood that the heating elements may expand to differing degrees from one another.

For use with these dual heating elements, the apparatus of the present invention includes a support bar 52 and a bracket means 54 for mounting the support bar to again be suspended from the top of the oven. Support bar 52 comprises a generally rectangular plate 56 having slots 58*a*–58*f* spaced along the length of the plate. As before, the slots open into the body of the plate 56 from the top of the plate.

Plate 56 extends substantially across the width of the oven with the length of the plate being greater than the width of the heating element as now measured between the longitudinal segments S5, S6 of heating element H2. The support bar is installed so the center of the plate corresponds to the longitudinal axis or centerline of both heating elements. Slots 58*a*–58*c* are formed in the plate to one side of the centerline, and slots 58*d*–58*f* are on the other side of the centerline. Slots 58*a* and 58*d*, slots 58*b* and 58*e*, slots 58*c* and 58*f* are respectively equidistantly spaced from the centerline of the plate. Each slot is again J-shaped and formed with one end open and the other end covered by a portion of the plate. The height the slots, including their covered portion, corresponds to at least the diameter of the segments of the heating elements. And, the width of each slot is at least twice the diameter of the segments with the width of the covered portion of each slot corresponding to the diameter of the heating elements. Although not shown in the drawings, installation of the segments of the heating elements in the slots is similar to that shown in FIG. 10. Now, the portions of the longitudinal segments of heating element H1 are fitted into slots 58*a*, 58*b*, 58*d*, and 58*e*, and those of heating element H2 in slots 58*c* and 58*f*. When installed in the manner previously described, each segment of the respective heating elements is constrained to move only parallel to the longitudinal axis of the heating element so, again, there is no warpage of the heating elements and a uniform distribution of heat throughout the oven.

Bracket means 54 comprises a pair of inverted L-shaped brackets 54*a*, 54*b* which are secured to plate 56 by a rivet 60. These brackets are secured to the top wall of the oven. The terminal ends of the heating elements fit through respective mounting brackets 62*a*, 62*b* each of which comprises plates having a pair of openings for the terminal end portions of both heating elements to fit. The brackets are secured to the back wall B of the oven.

What has been described is a support bar for use in an electric oven for supporting one or more electric heater elements used to cook food set into the oven. The support bar is readily mounted inside the oven and supports a heating element so as to allow its full expansion and contraction along a longitudinal axis of the element during a heating cycle. The support bar has a plurality of spaced slots in which portions of respective segments of the heating element are received, the slots being open at one end for insertion of the heating element, and closed at the other end. This enclosed end of the slots engage respective segments of a heating element to control its movement in the longitudinal direction of the heating element. The heating element is readily removable to facilitate installation of a replacement element. The support bar can support two, separate heating elements and can support both elements even though they may expand or contract to different degrees. The support bar is available in different sizes for use with different size heating elements, and the support bars provide a low cost, dependable way to install electrical heating elements in ovens.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus supporting an electrical heating element installed in an oven and extending generally horizontally therethrough from one side of the oven to an opposite side thereof for heating the oven to bake or broil food set in the oven, the heating element expanding and contracting along its length as the heating element heats up and cools down as electrical energy is first supplied to and then later shut off from the heating element, the apparatus comprising a support bar including an elongate plate extending horizontally of said oven and means for mounting said plate from a top wall of said oven for said support bar to extend orthogonally of a longitudinal axis of said heating element when said heating element is installed in the oven, said plate having a plurality of openings formed therein each of which is generally presented in the upward vertical direction and sized for a length of said heating element to be installed in said opening for said heating element to be horizontally supported by said support bar, each said opening comprising a horizontally extending slot formed intermediate ends of said support bar with one end of said slot opening into the body of said plate from an upper surface thereof for a portion of said plate to cover said end of said slot with the other end of the slot being op en to receive said heating element, expansion of said heating element occurring as said heating element is heated due to flow of electricity therethrough the portion of said heating element received in said slot being installed in the covered end of the slot and said expansion occurring in a direction for the heating element to be constrained in said slot and for the heating element to expand away from said end of the slot which is open to receive said heating element when the heating element heats up due to flow of electricity therethrough, said heating element forming a sinuous pattern having a plurality of horizontal segments forming longitudinal reaches of the heating element with a portion of the heating element forming each of said reaches supported in one of said slots.

2. The apparatus of claim 1 wherein one end of each of said slots extends into the body of said plate for a portion of said plate to cover said slot with the other end of the slot being open to receive said portion of said heating element segment, the portion of said heating element segment received in said slot being fitted into the covered end of the slot thereby for a portion of the heating element to be constrained in said slot.

3. The apparatus of claim 2 wherein one-half of said slots are formed in said plate on one side of a longitudinal centerline of said heating element, when said heating element is installed in said oven, and the other half of the slots are spaced on the other side thereof.

4. The apparatus of claim 3 further including a second heating element installed in said oven with the first said heating element, said second heating element being coplanar with the first said heating element and said support bar supporting said second heating element in addition to the first said heating element.

5. The apparatus of claim 4 wherein said plate includes additional slots for supporting portions of said second heating element, said additional slots being correspondingly formed as the aforesaid slots.

6. The apparatus of claim 2 wherein the height of each slot, including the covered portion thereof, corresponds to the diameter of the portion of the heating element supported in the slot, and the width of each slot is at least twice the diameter of the portion of the heating element supported in the slot.

7. The apparatus of claim 6 wherein the width of the covered portion of each slot corresponds to the diameter of the portion of the heating element supported in the slot.

8. A support bar supporting an electrical heating element installed in an oven and extending generally horizontally therethrough from one side of the oven to an opposite side thereof for heating the oven to cook food, the heating element having a sinuous shape and expanding and contracting along its length as the heating element heats up and cools down when electrical energy is supplied to and then shut off from the heating element, the support bar comprising an elongate plate extending horizontally of said oven and bracket means mounting said plate from a top wall of said oven, said heating element having a plurality of horizontally extending segments extending longitudinally of said oven and said support bar extending orthogonally of a longitudinal axis of said heating element, said plate having a plurality of openings formed therein each of which is generally presented in the upward vertical direction and sized for a portion of a heating element segment to be received in said opening and supported by said support bar, each said opening comprising an elongate, horizontally extending slot formed intermediate the ends of said support bar, one end of each slot opening into the body of said plate from an upper surface thereof for a portion of said plate to cover one end of said slot with the other end of the slot being open to receive said portion of said heating element segment, the height of each slot, including the covered portion thereof, corresponding to the diameter of the portion of the heating element supported in the slot, and the width of each slot being at least twice the diameter of the portion of the heating element supported in the slot, expansion of said heating element occurring as said heating element is heated due to flow of electricity therethrough the portion of said heating element segment received in each said slot being installed in the covered end of the slot and said expansion occurring in a direction for the heating element to be constrained in said slot and for the heating element to expand away from the end of said slot which is open to receive said heating element when the heating element heats up due to current flow therethrough.

9. The support bar of claim 8 wherein said heating element includes an electrical terminal at each end thereof, said electrical terminals being electrically connected to a circuit at a backwall of said oven, and aid bracket means includes spaced brackets attached to said plate inwardly from opposite ends of said plate to suspend said support bar from a top wall of said oven.

10. The support bar of claim 9 wherein a portion of said slots are formed in said plate on one side of the longitudinal centerline of said heating element, when said heating element is installed in said oven, and the remainder of the slots are spaced on the other side thereof.

11. The support bar of claim 9 wherein the height of each slot, including the covered portion thereof, corresponds to the diameter of the portion of the heating element supported in the slot, and the width of each slot is at least twice the diameter of the portion of the heating element supported in the slot.

12. The support bar of claim 9 wherein the width of the covered portion of each slot corresponds to the diameter of the portion of the heating element supported in the slot.

13. The support bar of claim 8 including a second heating element installed in said oven with the first said heating element, said second heating element being coplanar with the aforesaid heating element and said support bar supporting said second heating element together with the first said heating element.

14. The support bar of claim 13 wherein said plate includes additional slots for supporting portions of said second heating element, said additional slots being correspondingly formed as the aforesaid slots.

15. A support bar supporting a plurality of electrical heating elements installed in an oven for heating the oven to cook food, there being at least two heating elements and said support bar mounting said heating elements coplanar with each other, each heating element having a plurality of longitudinally extending segments which expand and contract as the heating element heats and cools, the support bar comprising an elongate plate and bracket means for mounting said plate to an inner wall of said oven, said support bar extending orthogonally of the longitudinal axes of said heating elements, said plate having a plurality of openings formed therein each of which is generally presented in the upward vertical direction and sized for a portion of said longitudinally extending segments to be received in said openings and supported by said support bar, each said opening comprising a slot one end of which extends into the body of said plate for a portion of said plate to cover one end of said slot with the other end of the slot being open to receive said portion of said segments of said heating elements, expansion of said heating element occurring as said heating element is heated due to flow of electricity therethrough, the portion of said segments received in each said slot being installed in the covered end of the slot for the heating elements to be constrained in said slots and said expansion occurring in a direction to expand away from the end of the slot which is open to receive said heating element when the heating elements heat up due to current flow through the respective elements.

16. The support bar of claim 15 wherein each said heating element includes an electrical terminal at each end thereof, said electrical terminals being electrically connected to a circuit at a backwall of said oven, and said bracket means includes spaced brackets attached to said plate inwardly from opposite sends of said plate to suspend said support bar from a top wall of said oven.

17. The support bar of claim 16 wherein the longitudinal axes of said first and second heating elements are coincident and a portion of said slots are formed in said plate on one side of the longitudinal centerline of said heating element, when said heating element is installed in said oven, and the remainder of the slots are spaced on the other side thereof.

18. The support bar of claim 17 wherein one said heating element is installed outwardly of the other said heating element and the respective outer slots on either end of the support bar support the longitudinally extending segments of said one heating element.

19. The support bar of claim 15 wherein the height of each slot, including the covered portion thereof, corresponds to the diameter of the portion of the heating element supported in the slot, the width of each slot is at least twice the diameter of the portion of the heating element supported in the slot, and the width of the covered portion of each slot corresponds to the diameter of the portion of the heating element supported in the slot.

* * * * *

UNITED STATES PATENT AND TRADEMARK OFFICE

CERTIFICATE OF CORRECTION

PATENT NO : 6,097,003

DATED : August 1, 2000

INVENTOR(S) : Markum, et al

It is certified that error appears in the above-identified patent and that said Letters Patent are hereby corrected as shown below:

Col. 6, Line 31
Replace "op en" with -- open

Col. 7, Line 50
Replace the word "aid" with --said

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*